United States Patent [19]

Lopez

[11] Patent Number: 4,624,393

[45] Date of Patent: Nov. 25, 1986

[54] SPLIT HUB ASSEMBLY FOR A NECKED DOWN CARTRIDGE TUBE

[75] Inventor: Claudio Lopez, Silver Spring, Md.

[73] Assignee: Survival Technology, Inc., Bethesda, Md.

[21] Appl. No.: 279,956

[22] Filed: Jul. 2, 1981

[51] Int. Cl.[4] ..... B67D 5/08

[52] U.S. Cl. ..... 222/83.5; 222/89; 604/240

[58] Field of Search ..... 222/81, 83, 83.5, 88, 222/89; 128/218 R, 218 N, 221, 272.3; 215/274, 275, 276; 604/240–242

[56] References Cited

U.S. PATENT DOCUMENTS

| | | | |
|---|---|---|---|
| 2,158,593 | 5/1939 | Scrimgeour | 128/221 |
| 2,957,501 | 10/1960 | Holmes | 128/272.3 |
| 3,739,779 | 6/1973 | Pfleger | 128/218 DA |
| 3,989,044 | 11/1976 | Meierhoefer | 128/218 N |
| 4,334,536 | 6/1982 | Pfleger | 128/218 DA |

FOREIGN PATENT DOCUMENTS

| | | | |
|---|---|---|---|
| 2813940 | 10/1978 | Fed. Rep. of Germany | 215/274 |

*Primary Examiner*—Joseph J. Rolla
*Attorney, Agent, or Firm*—Witherspoon & Hargest

[57] ABSTRACT

A split hub assembly for use in conjunction with a cartridge assembly including a cylindrical cartridge tube having a necked down end terminating in an annular flange, the split hub assembly including a needle holder having a forward and a rearward end with a passage connecting the ends. A cylindrical body extends from the rearward end of the needle holder and surrounds a hollow spike extending from the rearward end of the needle holder in communication with the passage in the holder. A pluarlity of flexible segments extend rearwardly from the rearward end of the cylindrical body, each segment having a locking lip extending inwardly from the free end of the segment. The cylindrical body has a first locking portion adjacent the forward end portion of the body and a second locking portion adjacent the forward end portion of the body and a second locking portion adjacent the rearward end of the body. A locking portion comprising a cylindrical sleeve has an inturned locking member on its forward end which is sized to engage the first and then the second locking portion, whereby, with the locking member engaging the first locking portion on the cylindrical body and the flexible segments positioned over and around the annular flange on the necked end of the cartridge tube, rearward movement of the locking portion causes the cylindrical sleeve to engage the flexible segments and force them inwardly whereby the locking lips fit in against the rearward portion of the annular flange to secure the split hub assembly to the cartridge tube while the locking member engages the second locking portion to retain the locking means in position.

5 Claims, 4 Drawing Figures

SPLIT HUB ASSEMBLY FOR A NECKED DOWN CARTRIDGE TUBE

SUMMARY OF THE INVENTION

This invention relates to syringes and more specifically to the structure which cooperates with a necked down cartridge tube to retain the diaphragm type closure and injection needle in assembled condition thereon.

In the syringe field many different structural arrangements have been used to secure the needle to a cartridge tube wherein the cartridge tube is necked down at the needle end.

One arrangement for securing the diaphragm and needle hub plus needle to a necked down type of catridge tube is shown in Sarnoff U.S. Pat. No. 3,391,695 wherein needle holder 20 and diaphragm 36 are secured to the annular flange 30 of the necked down cartridge tube by means of an aluminium collar 28 which is spun over on both ends to assemble the parts to the annular flange 30.

In Sarnoff U.S. Pat. No. 3,450,135 the needle mounting hub has a cylindrical portion which fits over the flange of the diaphragm and is spun over the back side of the annular flange on the cartridge tube to provide an assembled unit.

In De Liste U.S. Pat. No. 791,802 one end portion of the needle is embedded in a rubber stopper having an opening adapted to receive the end portion of the syringe tube which is necked down and provided with an annular bead.

Pierce U.S. Pat. No. 1,139,368 in FIG. 3 illustrates an annular assembly including a needle 26 held by a cylindrical holder 28 which is slightly tapered on its inner surface to cooperate with the cone shaped portion of nipple 3 on which the holder is fitted.

In Payne U.S. Pat. No. 1,012,700 barrel 12 is provided with a threaded end having a reduced diameter and adapted to receive a threaded needle hub 13 mounting a needle 14.

The above described patents are only illustrative of some of the various ways of attaching a needle to a cartridge tube.

It is an object of the present invention to provide a split hub assembly for use on a cartridge tube having a necked down end with an annular flange to receive said hub assembly.

It is another object of this invention to provide a split hub assembly having means for locking the assembly onto the annular flange on the cartridge tube.

It is yet another object of this invention to provide a split hub assembly having a collet assembly adapted to fit over the annular flange on the cartridge and a locking sleeve fitting over the collet assembly to retain same in locked engagement with the annular flange.

It is a still further object to provide a split hub assembly including a needle holder, a cylindrical body and a collet assembly with a locking sleeve adapted to slidably engage the collet for locking purposes.

It is still another object of this invention to provide a split hub assembly as set forth above and wherein the needle holder has a central through passage in communication with a hollow spike extending centrally from said holder.

The above and additional objects and advantages will become more apparent when taken in conjunction with the following detailed description and drawings, illustrating by way of example, one preferred embodiment of this invention.

IN THE DRAWINGS

FIG. 1 is an exploded view illustrating the components of the invention,

FIG. 2 illustrates the assembled split hub assembly ready for application to the necked end of a cartridge, FIG. 3 shows the split hub assembly initially positioned on the cartridge with the diaphragm closing off the cartridge opening and the locking sleeve in retracted position, and FIG. 4 shows the split hub assembly completely attached to the end of the cartridge with the locking sleeve in its locked position to retain the hub assembly on the end of the cartridge.

DETAILED DESCRIPTION

The split hub assembly of this invention can conveniently be used in the cartridge assemblies disclosed in Sarnoff U.S. Pat. Nos. 3,391,695 and 3,450,135 and such patents are incorporated herein for reference purposes.

Figure 1:
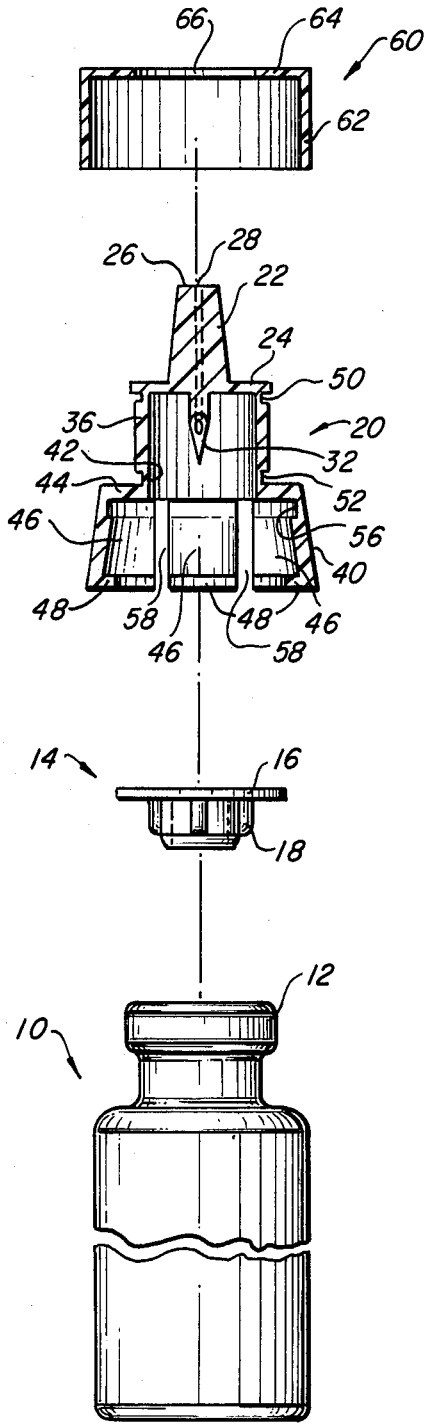

Referring to FIG. 1, wherein the components of the split hub assembly, diaphragm and cartridge tube are illustrated in exploded form; glass cartridge tube 10 is cylindrical and has a necked down end with an annular flange 12 on the end thereof.

The cartridge tube end with the annular flange 12 is closed by means of a diaphragm 14 having a flat disc-like base 16 whose diameter is generally coextensive with that of the annular flange 12. A cylindrical plug section 18 extends downwardly from the base 16 and is sized to snugly fit within the opening formed by the annular flange and adjacent cartridge tube.

The split hub 20 comprises a needle holder 22 which is somewhat cone shaped tapering inwardly and forwardly from the circular base 24 to the forward end 26. A central passage 28 extends completely through the needle holder. It is in this passage into which the needle would be fitted, as shown in Sarnoff U.S. Pat. No. 3,450,135. A hollow spike 32 extends centrally and rearwardly from circular base 24 in communication with needle holder passage 28. A cylindrical body 36 extends from the circular base 24 and has its central axis coaxial with that of the passage 28 in the needle holder 22.

A circular collet 40 extends from the rearward end 42 of the circular body 36 and comprises a circular shoulder 44 with rearwardly extending segmented fingers 46. Each finger 46 has an inturned locking lip 48 extending inwardly from its rearward end. These locking lips 48 when compressed form a segmented annular locking means. The circular body 36 has a peripheral locking groove 50 formed in its outer surface adjacent the circular base 24 and has a second peripheral locking groove 52 in its outer surface adjacent collet shoulder 44. The circular collet 40 is provided with a circular recess 56 in its inner surface adjacent the collet shoulder 44. In order to make the segmented collet fingers 46 reasonably flexible slots 58 extend forwardly to the collet shoulder 44.

The locking sleeve 60 as shown comprises a cylindrical sleeve 62 with its forward end provided with an inwardly directed locking flange 64 forming with its inner edge an opening 66 sized to allow assembly over circular base 24. It should be pointed out that both the locking sleeve and the split hub are made from plastic which is somewhat resilient and flexible.

Figure 2:
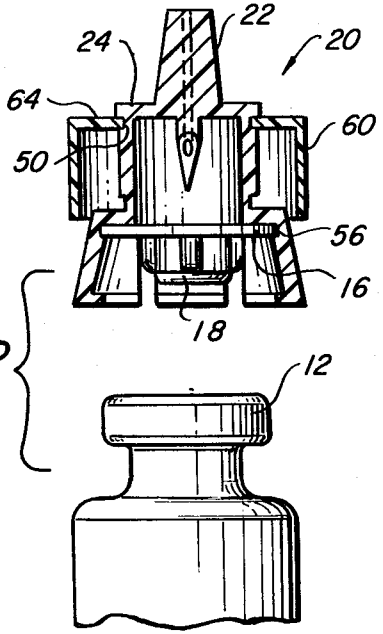

FIG. 2 illustrates the first step in assembly wherein the edge portion of diaphragm base 16 is fitted into circular recess 56. Next, locking sleeve 60 is slipped over needle holder base 24 so that locking sleeve flange 64 will fit into peripheral locking groove 50.

Figure 3:
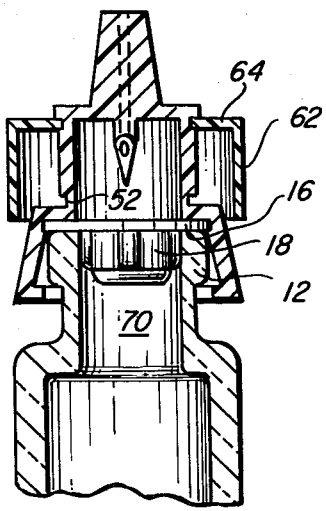

Thus, with locking sleeve 60 and diaphragm 14 assembled with the split hub 20, the so assembled unit is then positioned on the end of the cartridge tube 10 as illustrated in FIG. 3. The plug section 18 of the diaphragm is forced into the opening 70 in the top portion of the cartridge tube 10 so that the diaphragm base 16 engages the annular flange 12 on the top of the cartridge tube 10.

Figure 4:
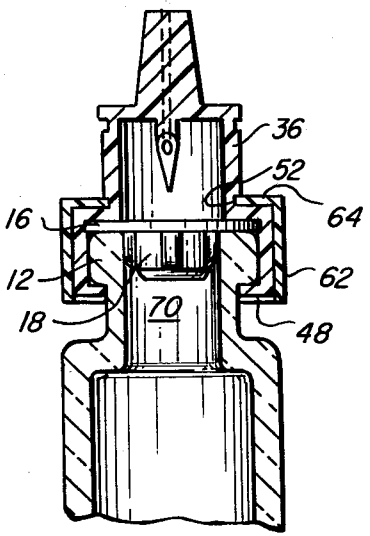

As shown in FIG. 4, the locking sleeve 60 is moved rearwardly so that the sleeve 62 engages the locking fingers 46 and forces the locking lips 48 up behind the annular flange 12 to secure the unit to the cartridge tube 10. In order to make certain that the locking sleeve 60 does not slip out of position the locking flange 64 fits into locking groove 52 in the cylindrical body 36. If it is desired to disassemble the split hub, i.e., remove it from the cartridge tube, the locking sleeve 60 is merely moved forwardly allowing the locking lips 48 to swing outwardly from behind the annular flange 12. With the split hub in such condition it may be removed from the cartridge tube.

As stated earlier in the specification, it is intended that the split hub assembly of this invention would be made from a flexible material which does not present sterilizing problems such as plastics.

What is claimed is:

1. A split hub assembly for use in conjunction with a cartridge assembly including a cylindrical cartridge tube having a necked down end terminating in an annular flange, said split hub assembly comprising:

a needle holder having a forward end and a rearward end with a passage connecting said ends, the forward end portion being adapted to receive a needle, a cylindrical body having a forward end and a rearward end with its forward end extending rearwardly from the rearward end of the needle holder, a plurality of flexible segments extending rearwardly from the rearward end of the cylindrical body, each segment having a locking lip extending inwardly from the free end of the segment, the cylindrical body having a first locking means adjacent the forward outer end portion of said body and a second locking means adjacent the rearward outer end of the body, and a cylindrical sleeve having a forward end and a rearward end with an inside diameter sized to engage and force inwardly the flexible segments extending rearwardly from the rearward end of the cylindrical body, a flange extending inwardly from the forward end of said sleeve and sized to engage the first and then the second locking means on the cylindrical body, whereby with the cylindrical sleeve fitting down around the cylindrical body with the flange of the cylindrical sleeve engaging the first locking means on said cylindrical body and the flexible segments positioned over and around the annular flange on the cartridge tube rearward movement of the cylindrical sleeve causes said sleeve to engage the flexible segments and force them inwardly so that the locking lips fit in against the rearward portion of the annular flange to secure the split hub assembly to the cartridge tube, the flange of the cylindrical sleeve engaging the second locking means to retain said sleeve in position.

2. The invention as set forth in claim 1 and wherein the first locking means is a first peripheral groove in the cylindrical body and the second locking means is a second peripheral groove in said body.

3. The invention as set forth in claim 1 and wherein the plurality of flexible segments is a collet comprising a circular shoulder connected to the rearward end of the cylindrical body with a plurality of flexible fingers extending rearwardly therefrom, each finger having an inturned locking lip on its free end.

4. The invention as set forth in claim 3 and wherein the collet has an internal circular groove adapted to receive the outer portion of the disc section of a diaphragm which comprises a disc section with a circular plug section extending therefrom whereby the plug section will fit into the open end of the cartridge tube surrounded by the annular flange.

5. A split hub assembly for use in conjunction with a cartridge assembly including a cylindrical cartridge tube having a necked down end terminating in an annular flange, said split hub assembly comprising:

a needly holder having a forward end and a rearward end with a passage connecting said ends, the forward end portion being adapted to receive a needle, a cylindrical body having a forward end and a rearward end with its forward end extending rearwardly from the rearward end of the needly holder, a collet assembly extending from the rearward end of the cylindrical body, said collet assembly including a circular shoulder connected to the rearward end of the cylindrical body, a plurality of flexible collet fingers extending rearwardly from the circular shoulder, each finger having a locking lip extending inwardly from the free end thereof, an internal circular groove formed in the flexible collet fingers adjacent the circular shoulder, a diaphragm comprising a disc portion with a circular plug of lesser diameter extending centrally therefrom, said plug being sized to snugly fit into the open end of the cartridge tube with that portion of the disc extending outwardly beyond the plug fitting on the annular flange of cartridge, the disc portion of the diaphragm fitting in and held by the internal circular groove in the flexible collet fingers, the cylindrical body having a first peripheral locking groove adjacent the outer forward end portion of said body and a second peripheral locking groove adjacent the outer rearward end of the body, and a cylindrical sleeve having a forward end and a rearward end with an inside diameter sized to engage and force inwardly the flexible fingers extending rearwardly from the rearward end of the cylindrical body, a flange extending inwardly from the forward end of said sleeve and sized to engage the first and then the second locking means on the cylindrical body, whereby with the cylindrical sleeve fitting down around the cylindrical body with the flange of the cylindrical sleeve engaging the first locking means on said cylindrical body and the flexible fingers positioned over and around the annular flange on the cartridge tube rearward movement of the cylindrical sleeve causes said sleeve to engage the flexible fingers and force them inwardly so that the locking lips fit in against the rearward portion of the annular flange to secure the split hub assembly to the cartridge tube, the flange of the cylindrical sleeve engaging the second locking means to retain said sleeve in position.

* * * * *